United States Patent [19]

Carpenter, Jr. et al.

[11] Patent Number: 4,739,937

[45] Date of Patent: Apr. 26, 1988

[54] APPARATUS FOR CONDITIONING GRANULAR MATERIAL

[75] Inventors: James H. Carpenter, Jr.; Jerry L. Godwin; Donald G. Corderman; Haven L. Keller, all of Hagerstown, Md.

[73] Assignee: Pangborn Corporation, Hagerstown, Md.

[21] Appl. No.: 8,474

[22] Filed: Jan. 29, 1987

Related U.S. Application Data

[63] Continuation-in-part of Ser. No. 767,296, Aug. 19, 1985, abandoned.

[51] Int. Cl.[4] ..... B02C 19/00

[52] U.S. Cl. ..... 241/79.1; 241/275; 241/291; 241/DIG. 10

[58] Field of Search ..... 241/DIG. 10, 5, 275, 241/79.1, 48, 52, 53, 80, 97, 291, 57

[56] References Cited

U.S. PATENT DOCUMENTS

| | | | |
|---|---|---|---|
| 2,585,657 | 2/1952 | Keeper | 241/275 X |
| 3,782,643 | 1/1974 | Carpenter | 241/DIG. 10 X |
| 3,881,664 | 5/1975 | Bowling et al. | 241/DIG. 10 X |
| 4,436,138 | 3/1984 | Kondo | 241/DIG. 10 X |

FOREIGN PATENT DOCUMENTS 1195226 6/1970 United Kingdom .

*Primary Examiner*—Mark Rosenbaum

*Attorney, Agent, or Firm*—Charles E. Brown; Charles A. Brown

[57] ABSTRACT

Apparatus for conditioning a granular material having a centrifugal throwing wheel for projecting the material radially against an impact surface member which completely surrounds and is spaced from the periphery of the wheel and includes an impact plate and ricochet plates. The impact plate is provided with generally radially disposed baffles with sides of adjacent baffles guiding and channeling the stream of material. The baffles are triangular in cross section with a forwardly facing side sloping at a lesser angle than the other side. The general course of granular material is downwardly through the apparatus and to retard this flow and thereby promote separation of granular material from fines, bed baffles which entrap and hold granular material are provided within the apparatus. Apparatus is provided for introducing a stream of air into the apparatus for transverse flow across the retarded downward stream of granulated material to effect separation of fines.

20 Claims, 3 Drawing Sheets

APPARATUS FOR CONDITIONING GRANULAR MATERIAL

This application is a continuation in part of our copending application Ser. No. 767,296, filed Aug. 19, 1985, now abandoned.

BACKGROUND OF THE INVENTION

This invention relates to apparatus for conditioning granular material, especially sand for reclamation.

Reconditioning of used sand, particularly foundry sand, involves reducing used core elements and molded sand lumps into individual grains. The quality of reclaimed sand must be comparable to that of new sand so that it may be satisfactorily substituted for new sand in core and molding sand mixtures. Thus, it is usually necessary to remove accumulated coatings from around individual sand grains. The accumulated coatings may be inorganic, such as clay minerals for grain molding sand, organics such as pitch, cereals and resins, or combinations such as clay used in conjunction with seal coal, pitch and cereals.

Reclamation systems of the prior art have generally crushed lumps of molded sand in a hammermill, ring crusher, jaw or roll crusher. The coatings on the sand grains are then removed by one of several methods known in the prior art; i.e., the wet method, the thermal method and the pneumatic method. The wet method of reclamation consists of mixing the sand with water with a mechanical scrubbing action. A considerable portion of the coating on the sand grains may be removed depending upon the efficiency of the scrubbing and the type of coating. In the thermal method of reclamation, the sand is heated at a temperature of about 1200° F. to about 1500° F. This treatment completely removes the carbonaceous matter. In the pneumatic method of reclamation, pneumatic sand scrubbers utilize low pressure air to make used sand grains sandblast each other. The disadvantages of this latter system are the high power requirements necessary to generate the high velocity air stream and the necessity for having the sand in a free-flow condition. To a certain extent, these disadvantages have been corrected by methods described in a British patent specification No. 1,195,226. A method for removing coatings on sand is described wherein the sand is thrown against a target by a mechanical throwing means with sufficient force to free contaminants from the particles of sand. However, this latter system does not effectively minimize power requirements or achieve adequate removal of contaminants from the conditioned particles.

U.S. Pat. No. 3,782,643, issued Jan. 1, 1974, and U.S. Pat. No. 3,881,664, issued May 6, 1975, are representative of state-of-the-art sand conditioning apparatus of the type having a centrifugal throwing wheel for projecting a stream of material against an impact surface with air stream separation and removal of fines and contaminants from the sand particles. Sand conditioning apparatus of this type has been sold and successfully operated for about ten years. In recent years, howeveer, there has been an increased requirement for control of the amount of fines remaining in the mix after completion of the scrubbing cycles. The apparatus of the current design has not, in all cases, controlled the fines to the extent required. In some cases, additional equipment has been used for further treatment of reclaimed sand with the sand first fed into an elevator and then up into an air wash separator such as that shown in U.S. Pat. No. 3,368,677. Further, excessive wear of certain parts of the apparatus subject to erosive conditions due to impacting sand has been noted.

It will be understood that it would be highly desirable to improve the operation of the present conditioning apparatus of the centrifugal throwing wheel type to gain improved fines control and so eliminate the need for additional equipment and processing to control fines. If excessive wear of parts of the apparatus can be reduced, increased acceptance of the apparatus is likely.

SUMMARY OF INVENTION

Apparatus for conditioning a granular material having a centrifugal throwing wheel for projecting the material radially against an impact surface member which completely surrounds and is spaced from the periphery of the wheel and includes an impact plate and ricochet plates. The impact plate is provided with generally radially disposed baffle elements with sides of adjacent baffles guiding and channeling the stream of material. The baffle elements tend to lead to a more uniform distribution of granular material about the circumference of the impact surface member. The baffle elements are triangular in cross section with a forwardly facing side sloping at a lesser angle then the other side. The general course of granular material after contact with the impact surface member is downward through the apparatus and to retard this flow and thereby promote separation of the product granular material from fines, bed baffles which entrap and hold granular material may be provided within the apparatus. A somewhat tortuous path for the granular material is thus provided. Means are provided for introducing a stream of air into the apparatus for transverse flow across the retarded downward stream of granulated material to effect separation of fines.

DETAILED DESCRIPTION OF THE INVENTION

Although the detailed description of the present invention is primarily directed to the reclamation and conditioning of sand, it should be realized that the apparatus and process of this invention can be conveniently used to condition and scour particles of various materials other than sand.

Figure 1:
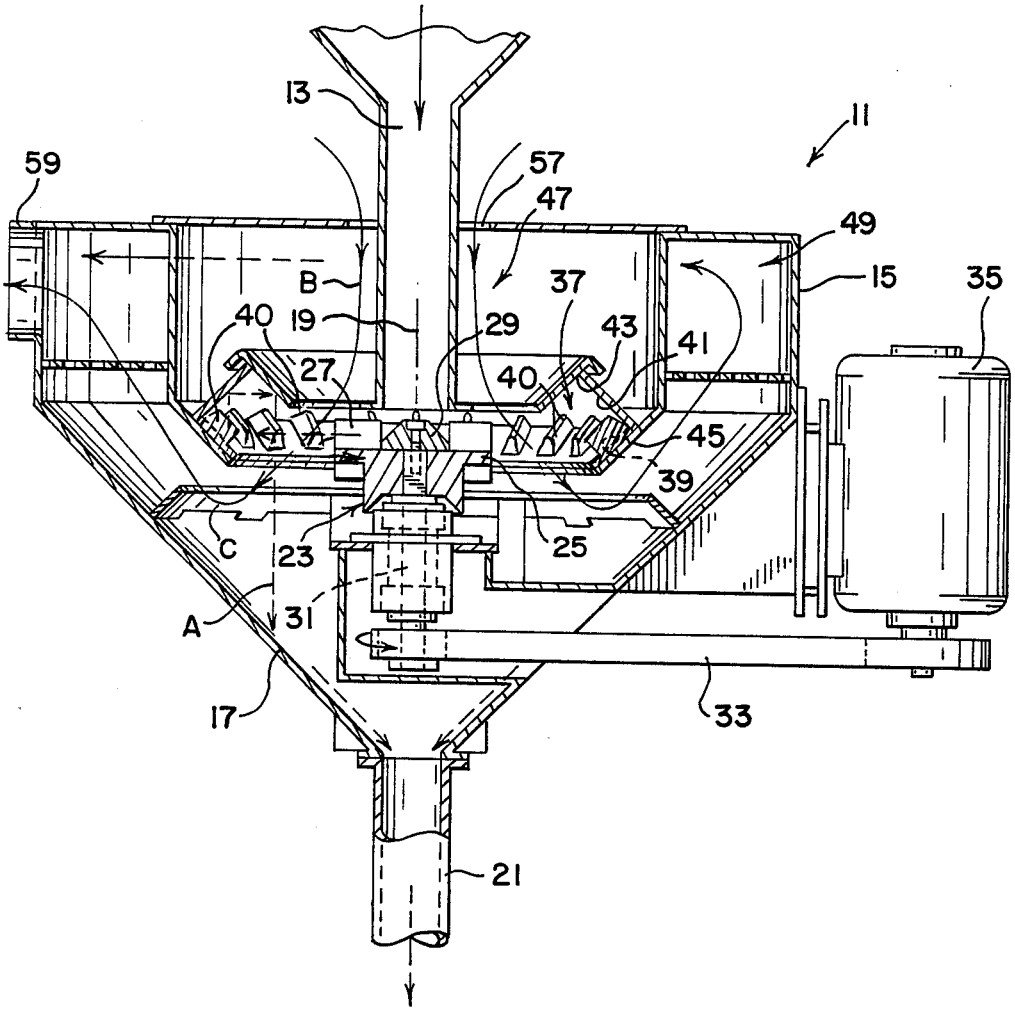
FIG. 1 is a side elevational view in section of an apparatus for conditioning granular material.

As seen in FIG. 1, sand which has been pulverized into granular sized particles but still retains coatings of resin or other material is fed into the conditioner 11 through a passage 13. The conditioner 11 subjects the sand in the mixture to a scouring treatment thereby removing accumulated coatings. The conditioner 11 includes an outer housing which is cylindrically shaped with a conical bottom 17. The side walls 15 of the housing are radially spaced from central axis 19. The passage 13 can serve as an inlet conduit for the input of material to be conditioned. The inlet conduit or passage 13 is in the top portion of the housing. An outlet conduit 21 is connected to the conical bottom 17 for the output of conditioned sand. The inlet conduit 13 and the outlet conduit 21 are coaxial with the central axis 19 of the housing. When in operation, the condition 11 is placed so that the central axis 19 is vertically aligned so that the material to be treated falls through the inlet conduit 13 and exits via the outlet conduit 21.

A centrifugal throwing wheel 23 is disposed intermediate the inlet conduit 13 and the outlet conduit 21. The throwing wheel 23 has an axis of rotation coaxial with the axis 19 and is disposed in the path of feed material falling through the inlet conduit 13. The feed material passing through the conduit 13 is projected generally horizontally outwardly by the throwing wheel 23.

The throwing wheel 23 includes a runnerhead 25 with a plurality of radially directed vanes 27. A distribution head 29 is cone shaped with the base of the cone contacting the central portion of the runnerhead 25 in the space in the center of the throwing wheel 23 between the vanes 27.

The runnerhead 25 is removably journaled on a spindle 31 and includes a square axially aligned opening which matches the similarly shaped end of the spindle 31 so as to provide a positive drive engagement. The distribution cone or head 29 is secured by bolting in place at the end of the spindle 31. This attachment also serves to keep the throwing wheel 23 in place.

The spindle 31 is axially aligned and mounted between spaced bearings for rotation. A pulley at the lower end thereof is driven by an endless belt 33 which is trained around another pulley which is connected to the shaft of a motor 35. The motor 35 is mounted exteriorly to the housing by suitable bracket.

The feed material is projected generally horizontally outwardly from the axis of rotation of the throwing wheel 23 so as to give a 360° coverage of projected particles. An impact surface 37 is radially spaced from the axis of rotation of the throwing wheel 23. From a top view the impact surface member 37 as illustrated in FIG. 2 is circular in shape so that the thrown particles travel a given distance before striking the impact surface 37.

Figure 2:
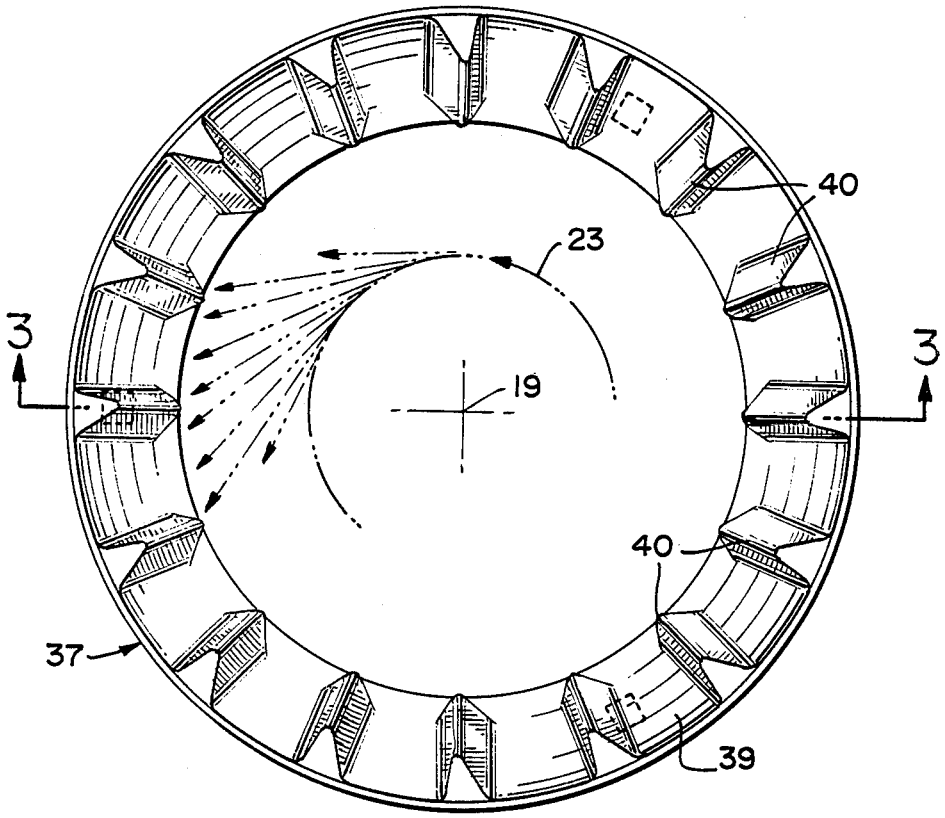
FIG. 2 is a detached plan view of the novel impact plate of this invention.
Figure 3:
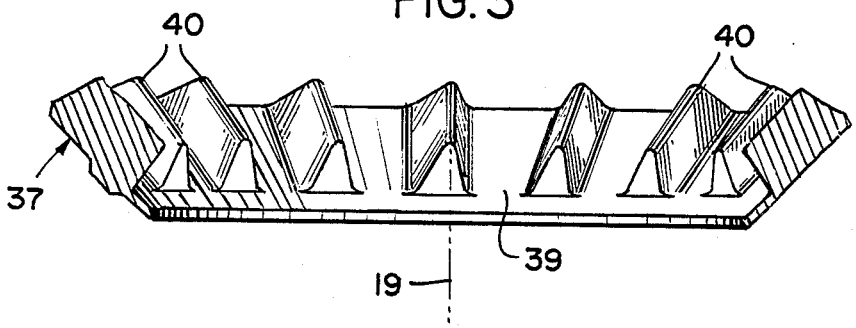
FIG. 3 is a view taken along line 3—3 of FIG. 2.

The impact surface member 37 as illustrated in detail in FIGS. 2 and 3 has a cross section which is shaped like a tilted U-shaped channel member. The impact surface member 37 includes an impact plate or wear plate or wall 39 which is positioned directly in the path of the projected particles and angularly disposed, preferably at about 45° angle so as to direct the projected particles upwardly after rebounding. The impact plate or wear plate 39 is provided with a plurality of radially located baffle elements 40 for dividing and guiding the stream of projected particles to promote a uniform distribution of particles about the impact plate and to reduce non-uniform wear of the impact plate. In one such structure sixteen baffles are provided on the impact plate, symmetrically spaced 22.5° apart.

It was found that excessive wear of the impact plate 39 occurred at the inner circumference of the plate; i.e., that portion of the plate closest to the throwing wheel. In an attempt to overcome this deficiency, the baffle elements were made of a tapered configuration in plan, with the broadest portion at the inner circumference close to the throwing wheel, and the narrowest portion at the outer circumference where less wear is anticipated. However, it has been found that this arrangement does not solve the problem. Accordingly, the baffle elements 40 are now made of a constant cross section as shown in FIG. 2, which cross section is triangular. The opposite faces of each baffle element 40 is sloped upwardly in converging relation, as shown in FIG. 3.

It will be seen that each forwardly facing face slopes at a greater angle to the wall than each rearwardly facing face. A preferred angle of slope for the forwardly facing face is 30°, while the preferred angle of slope for the rearwardly facing face is 10°.

Inner ends of the baffle elements 40 are arranged in a conical pattern, i. e., generally at an angle to the axis 29 and preferably normal to the plane of the impact plate. Outer ends of the baffle elements 40 slope upwardly and radially inwardly.

The foregoing baffle element configuration has provided good results while having an increased wear life for the impact surface member 37.

In addition, the impact plate 39 is of a width greater than the length of the baffle elements 40 and project radially inwardly beyond the inner ends of the baffle elements 40. By increasing the width of the impact plate 39 particles previously passing through the impact surface member are engaged and deflected.

A ricochet plate or wall 41 is connected to the impact plate or wall 39 at an angle, preferably at about a 90° angle thereto, so as to deflect rebounding particles from the impact plate 39 back toward the throwing wheel. A second ricochet plate or wall 43 is connected to and at about a 90° angle to the first ricochet plate 41. The second ricochet plate or wall 43 deflects particles downwardly toward the blast stream emanating from the centrifugal throwing wheel 23. This path is shown in FIG. 1 by a dotted line having arrows. The path is such that the collisions of the particles are maximized so that the scoured action is achieved. The particles fall into the conical bottom 17 where they exit via the conduit 21.

The impact surface member 37 is rigidly captured in place between wall 41 and wall 45. The inner wall 45 is connected to the outer wall 15 so as to form an inner chamber 47 and an outer chamber 49.

Each wear plate or wall 39, 41 or 43 is a closed or continuous wall having a central axis. Preferably the wall 39, 41 or 43 is arcuate in shape and is generated by rotating a line at an angle to the central axis about the central axis. If the wall 39, 41 or 43 is not arcuate preferably the general shape approaches that of a circle. In this latter case, the wall 39, 41 or 43 preferably has at least about three straight sides symmetrically arranged about the central axis. In this case, the side portions of each wall 39, 41 or 43 are at an angle to the central axis to give a resulting pyramidal shape.

The general shape of a wall 39, 41 or 43 is that of a frustrum with two parallel planes intersecting the pyramid or cone shaped sides. Both ends of a wall 39, 41 or 43 as described by the intersecting planes are open with one end being larger than the other end. Each plate or wall 39, 41 or 43 is preferably at an angle of about 45° with respect to the central axis. It has been found that this angle maximizes the scouring action.

The walls 39, 41 and 43 are stacked so that the impact plate or wall 39 has its larger end facing upwardly so as to project rebounding particles in that direction. The first ricochet plate or wall 41 has its larger end facing downwardly and engaging the larger end of the impact plate 39. This construction results in the particles being deflected back toward the centrifugal throwing wheel 23. Preferably, the second ricochet plate 43 has its larger end facing upwardly and engaging the smaller end of the first ricochet plate 41 so that the rebounding particles are projected downwardly through the blast stream. When the walls 39, 41 and 43 are in stacked relationship, the impact plate, the first and second ricochet plates are concentric and coaxial with the central axis 19.

In the embodiment shown in FIG. 1, the particles projected from the throwing wheel 23 are immediately subjected to an air stream which flows through the projected and falling particles. The air stream flows downwardly through an opening 57 in the top of the conditioner 11 and follows the path of the solid lines with arrows as illustrated in FIG. 1. The air stream flows through the inner chamber 47 and downwardly through the projected particles and upwardly toward the outer chamber 49. The air stream is drawn through the outer chamber 49 to an outlet 59 or several outlets which can be employed to evenly distribute the air flow. The outlet 59 is connected to a lower pressure source and a dust collector (not shown). The lighter particles such as dust or fines which are airborne are drawn through the outlet 59 and into the dust collector. The heavier particles continue to fall toward the bottom of the conditioner 11 or be driven against the impact surface member 37 a second time. This arrangement results in a ricocheting particle being subjected to the air stream immediately after leaving the throwing wheel 23 prior to ricocheting and then again before falling into the conical bottom 17.

Figure 4:
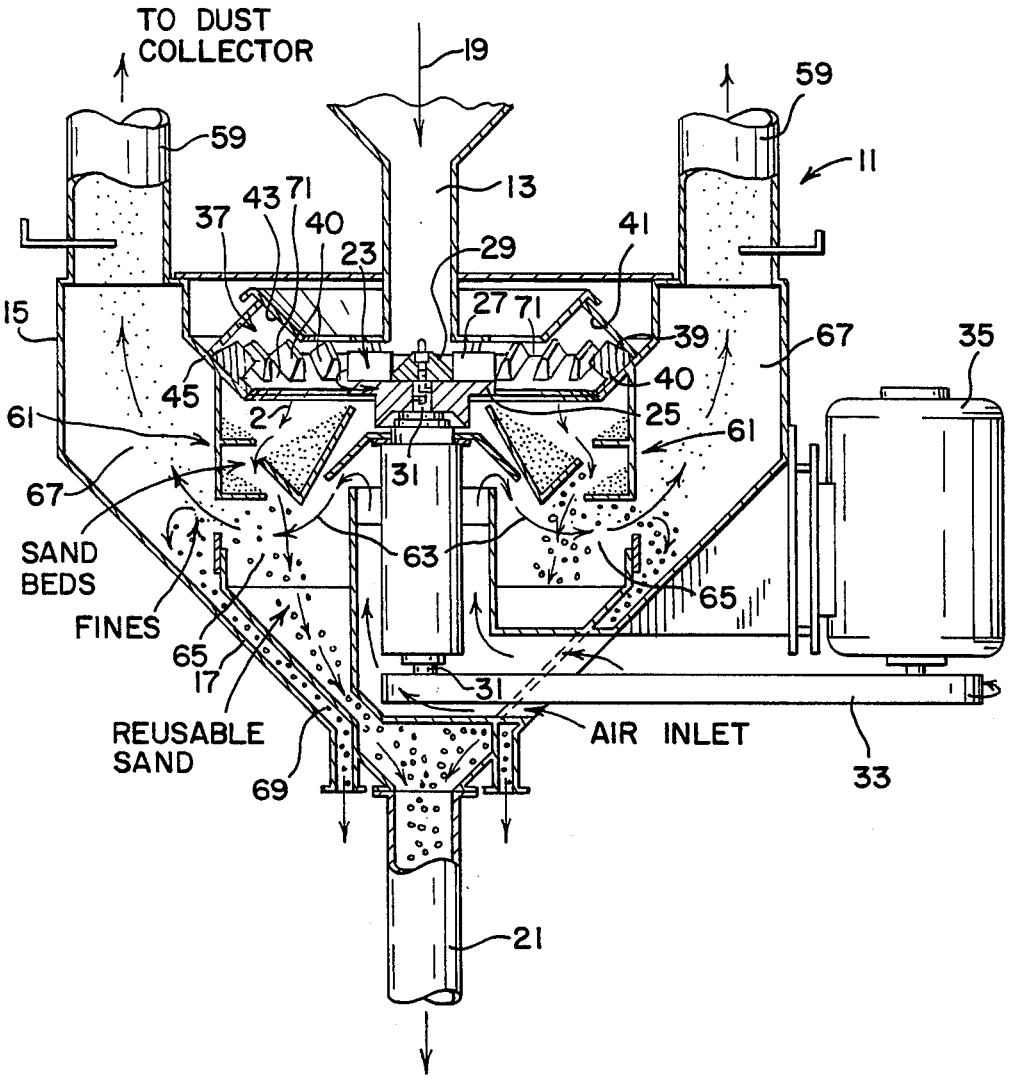
FIG. 4 is a side elevational view in section of an apparatus for conditioning granular material with structure which improves control of fines separation.

In FIG. 4 there is shown a further embodiment of an apparatus for conditioning a granular material with additional internal structure to retard the flow of the granular material to make the material more amenable to air separation and, further, a modified air flow pattern for more effective separation of fines. In this figure reference numerals which are identical to those of FIG. 1 represent similar or identical elements.

In the device of FIG. 1, the fines removal is not as effective as might be wished. The sand after hitting the impact surface member 37 drops down along line A. The air flow moves along line B. In the area just below the impact surface member it can be seen that the sand and air are traveling in the same direction—down. The air accelerates the sand and fines down. When the air changes direction at C, some of the fines and good sand will turn with it, however, some of the downwardly accelerated fines will not turn and thus will report in the product mix. Increasing the air flow helps to some extent, but in this case, the air flow carries increased amounts of both fines and good sand so that large reclaimers are required to drop out and recover the carried-over good sand. Testing has verified that increasing the air flow beyond a certain point does not improve fines removal substantially, but only increases the percentage of product sand loss.

In the improved embodiment of FIG. 4, the vertically dropping sand 2 from the impact surface member 37 is not accelerated by the air flow, but instead, is retarded by an array of sand bed baffles 61 to allow more time for a cross-flowing air stream 63 to wash out the fines. The air required for the cross-flow is ducted into the center of the apparatus along the same opening provided for the drive belt 33 and flows upwards about the spindle 31 and then outwards substantially horizontally into the scrubbing region 65 through which the sand is falling. The air passes first through the falling sand which reports to product outlet 21 and then into reclaiming region 67 where fine sand falls out to be discarded through passage 69 while the light fines and dust continue suspended in the air flow to the dust collector (not shown) through conducts 59.

As with the embodiment of FIG. 1, the impact plate 39 of the embodiment of FIG. 4 is provided with baffle elements 40. It is essential that the falling sand be uniformly distributed around the periphery of the air wash section after striking the impact surface member 37. Tests conducted with impact plates without baffles demonstrated that the sand does not fall equally around the periphery of the impact surface member. This maldistribution is attributed to air currents induced by the rotating impeller 27 which create vortices of swirling sand in area 71. The swirling sand gathers to form concentrations of sand at various points within the inner periphery of the impact susrface member. These sand accumulations drop vertically at the various locations around the periphery of the impact plates, adversely affecting the efficiency of the scrubbing region 65. Baffle elements 40, on impact plate 39, stop or at least curtail the rotary swirl and drop the sand equally around the 360° periphery of the impact surface member 37. It should be also noted that the sand vortices within impact surface member 37 greatly accelerate wear or erosion, particularly of impact member 39. The baffle elements 40 by curtailing sand vortices, and by simple shielding of member 39, greatly reduce wear on this member, which has, in the past, too frequently required replacement.

In comparative testing on molding sand used in the foundry of the smooth impact plates of the prior art with impact plates having baffle elements in accordance with this invention, it is found that an average 11 percent improvement in scrubbing rate is achieved. Further, a wear life increase for the impact plate of up to 60 percent is obtained; this is attributed to the more even distribution of sand and the shielding or masking of areas of the surface of the impact plates by the baffle elements.

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and appended claims.

We claim:

1. An apparatus for conditioning a granular material comprising:

a. a centrifugal throwing wheel for projecting granular material; b. means for feeding a granular material to said throwing wheel;

c. an impact surface member completely surrounding the periphery of said throwing wheel and spaced therefrom in the path of projected granular material; said impact surface member including an impact plate angularly positioned in the path of the projected granular material for deflecting said granular material upwardly and ricochet means for further deflecting the granular material downwardly through the path of granular material projected from said throwing wheel;

d. a plurality of baffle elements radially located on said impact plate, said baffle elements extending generally across the impact plate from the upper extremity thereof towards the lower extremity thereof; said baffle elements forming means for minimizing formation of sand vortices which cause excessive erosion of said impact plate and also for acting as barriers to shield the impact plate from erosion;

e. means for moving an air stream through said apparatus to contact the granular material and promote separation of fines from granular product; and f. means for collecting the granular product.

2. The apparatus of claim 1 wherein said centrifugal throwing wheel is supported for rotation about a substantially vertical axis so that the granular material is projected outwardly substantially horizontally.

3. The apparatus of claim 2 wherein said baffle elements each have an angled wall closest to the throwing wheel so that an upstanding surface is presented to the horizontally projected granular material.

4. The apparatus of claim 2 wherein a plurality of granular bed baffles are arranged below said impact surface member with said bed baffles forming means for retarding the velocity of granular material proceeding from said impact surface member by providing a tortuous path for said granular material.

5. The apparatus of claim 2 wherein said air stream moves through said apparatus between said impact surface and the periphery of said throwing wheel.

6. The apparatus of claim 1 wherein said baffle elements are of constant width as seen in plan and have forwardly facing and rearwardly facing faces each at an angle to a plane normal to that surface of said baffle plate on which said radial baffle elements are located, and said angle of said forwardly facing face being greater than the angle of the rearwardly facing face.

7. The apparatus of claim 6 wherein said impact plate member has an axis of rotation and said baffle elements have inner ends disposed at an angle to said axis.

8. The apparatus of claim 6 wherein said impact plate member extends radially inwardly beyond a base of each of said baffle elements and said baffle elements have inner ends disposed generally normal to the plane of said impact plate member and at an angle to said axis.

9. The apparatus of claim 1 wherein the baffle elements are symmetrically arranged on said impact plate at 22.5° intervals.

10. The apparatus of claim 1 wherein said air stream moves substantially horizontally across the path of the dropping granular material.

11. An apparatus for conditioning a granular material comprising:

a. a centrifugal throwing wheel for projecting granular material; b. means for feeding a granular material to said throwing wheel;

c. an impact surface member completely surrounding the periphery of said throwing wheel and spaced therefrom in the path of projected granular material; said impact surface member including an impact plate angularly positioned in the path of the projected granular material for deflecting said granular material upwardly and ricochet means for further deflecting the granular material downwardly through the path of granular material projected from said throwing wheel;

d. a plurality of baffle elements radially located on said impact plate, said baffle elements extending generally across the impact plate from the upper extremity thereof towards the lower extremity thereof; said baffle elements forming means for minimizing formation of sand vortices which cause excessive erosion of said impact plate and also for acting as barriers to shield the impact plate from erosion; and e. means for collecting the granular product.

12. The apparatus of claim 11 wherein said baffle elements are of constant width as seen in plan and have forwardly facing and rearwardly facing faces each at an angle to a radial plane normal to that surface of said baffle plate on which said baffle elements are located, and said angle of said forwardly facing face being greater than the angle of the rearwardly facing face.

13. The apparatus of claim 12 wherein a plurality of granular bed baffles are arranged in staggered configuration below said impact surface member to receive granular material dropping from said impact surface member and provide a tortuous path for said granular material thereby retarding the progress of said material through said apparatus and rendering it more susceptible to the separation process.

14. The apparatus of claim 12 wherein means is provided for moving an air stream through said apparatus substantially horizontally across the path of the granular material falling through said apparatus to effect separation of fines from granular product.

15. The apparatus of claim 12 wherein a chamber is provided to receive the fines-laden air stream after it passes through the falling granular material, a conduit communicating with said chamber for conducting intermediate fines which drop out of the air stream to discard and a second conduit connected to said chamber for conducting to discard light fines and dust with the entraining air stream.

16. An impact surface member for use in an apparatus for conditioning granular material comprising an impact plate member which is a hollow frustrum in shape having on the inner inclined surface thereof a plurality of radially located baffle elements extending generally across the impact plate member from the upper extremity thereof towards the lower extremity thereof, said baffle elements being of a constant width as seen in plan and having forwardly facing and rearwardly facing faces each at an angle to a radial plane normal to the inner inclined surface of said impact plate member, and said angle of said forwardly facing face being greater than the angle of the rearwardly facing face.

17. The impact surface member of claim 16 wherein said baffle elements are symmetrically positioned on said impact plate member at intervals of 22.5°.

18. The impact surface member of claim 16 wherein said impact plate member has an axis of rotation and said baffle elements have inner ends disposed at an angle to said axis.

19. The impact surface member of claim 16 wherein the angle of slope of said forwardly facing face is on the order of 30 and the angle of slope of said rearwardly facing face is on the order of 10°.

20. The apparatus of claim 16 wherein said impact plate member extends radially inwardly beyond a base of each of said baffle elements and said baffle elements have inner ends disposed generally normal to the plane of said impact plate member and at an angle to said axis.

* * * * *